US010145545B2

(12) United States Patent
Farrnbacher et al.

(10) Patent No.: US 10,145,545 B2
(45) Date of Patent: Dec. 4, 2018

(54) ORGANIC LIGHT-EMITTING ELEMENT HAVING QUICK DISCONNECT MEANS

(71) Applicant: OSRAM OLED GmbH, Regensburg (DE)

(72) Inventors: Joerg Farrnbacher, Regensburg (DE); Stefan Gschloessl, Nittendorf (DE); Christoph Gaerditz, Munich (DE); Christian Kristukat, Buenos Aires (AR)

(73) Assignee: OSRAM OLED GMBH, Regensburg (DE)

( * ) Notice: Subject to any disclaimer, the term of this patent is extended or adjusted under 35 U.S.C. 154(b) by 0 days.

(21) Appl. No.: 14/431,782

(22) PCT Filed: Sep. 24, 2013

(86) PCT No.: PCT/EP2013/069867
§ 371 (c)(1),
(2) Date: Mar. 27, 2015

(87) PCT Pub. No.: WO2014/048926
PCT Pub. Date: Apr. 3, 2014

(65) Prior Publication Data

US 2015/0241043 A1 Aug. 27, 2015

(30) Foreign Application Priority Data

Sep. 27, 2012 (DE) ..... 10 2012 109 158

(51) Int. Cl.
*F21V 19/00* (2006.01)
*F21V 23/00* (2015.01)
(Continued)

(52) U.S. Cl.
CPC ..... *F21V 23/002* (2013.01); *F21V 19/001* (2013.01); *F21V 19/0025* (2013.01);
(Continued)

(58) Field of Classification Search
CPC ..... F21V 19/003; F21V 19/0045; F21Y 2105/10; F21Y 2105/14; F21Y 2105/16
See application file for complete search history.

(56) References Cited

U.S. PATENT DOCUMENTS 2,216,220 A * 10/1940 Baker ..... E04C 1/42 313/116
3,056,897 A * 10/1962 Knochel ..... H05B 33/06 313/324
(Continued)

FOREIGN PATENT DOCUMENTS

DE 102011004909 A1 9/2012
DE 102011005808 A1 9/2012
(Continued)

OTHER PUBLICATIONS

International Search Report based on PCT/EP2013/069867 (4 pages and 3 pages of English translation) dated Jan. 3, 2014 (Reference Purpose Only).
(Continued)

*Primary Examiner* — Ismael Negron
(74) *Attorney, Agent, or Firm* — Viering Jentschura & Partner MBB

(57) ABSTRACT

A light-emitting element includes at least one flat light emitter having a first electrical contact portion formed on a side surface, and a housing partially surrounding the side surface of the flat light emitter, the housing including a second electrical contact portion formed on an inner surface of the housing and configured to mate with the first electrical contact portion.

11 Claims, 1 Drawing Sheet

(51) Int. Cl.
*F21V 23/06* (2006.01)
*F21Y 105/00* (2016.01)
*F21Y 115/15* (2016.01)
*F21Y 115/10* (2016.01)

(52) U.S. Cl.
CPC ..... *F21V 23/06* (2013.01); *F21Y 2105/00* (2013.01); *F21Y 2115/10* (2016.08); *F21Y 2115/15* (2016.08)

(56) References Cited

U.S. PATENT DOCUMENTS 5,662,408 A * 9/1997 Marischen ..... F21S 8/035 362/253
6,171,117 B1 * 1/2001 Chien ..... F21S 8/035 362/84
6,540,373 B2 * 4/2003 Bailey ..... E04B 9/32 362/147
6,764,196 B2 * 7/2004 Bailey ..... E04B 9/32 362/147
6,776,496 B2 * 8/2004 Cok ..... F21K 9/00 362/414
6,819,036 B2 * 11/2004 Cok ..... H01R 12/7076 313/318.01
6,949,772 B2 * 9/2005 Shimizu ..... F21L 4/00 257/88
7,108,392 B2 * 9/2006 Strip ..... G06F 1/1601 362/145
7,303,305 B2 * 12/2007 Kennedy ..... E04B 9/0435 362/147
7,322,718 B2 * 1/2008 Setomoto ..... H05B 33/0803 315/309
7,338,196 B2 * 3/2008 Bahramian ..... G02B 6/0008 362/555
7,344,296 B2 * 3/2008 Matsui ..... F21K 9/00 362/249.01
7,679,222 B2 * 3/2010 Patterson ..... H02G 3/00 174/480
7,810,953 B2 * 10/2010 Hsu ..... F21S 6/003 362/218
8,109,652 B2 * 2/2012 Chen ..... F21V 19/0045 362/218
8,215,787 B2 * 7/2012 Mathai ..... H01L 51/52 362/147
8,314,336 B2 * 11/2012 Liang ..... E04B 9/0428 174/40 R
8,344,602 B2 * 1/2013 Lai ..... F21V 19/0025 313/46
8,552,440 B2 * 10/2013 Yamazaki ..... H01L 27/3202 257/88
8,573,805 B2 * 11/2013 Leung ..... F21S 2/005 362/249.02
8,882,332 B2 * 11/2014 Que ..... F21V 19/004 362/217.13
2002/0117954 A1 8/2002 Nagano et al.
2006/0077669 A1 * 4/2006 Thielemans ..... G06F 3/14 362/368
2007/0252161 A1 * 11/2007 Meis ..... H01L 33/483 257/88
2011/0242811 A1 * 10/2011 Cheng ..... F21V 19/0045 362/249.03
2012/0092857 A1 * 4/2012 Sumiyama ..... F21S 8/086 362/190
2013/0329438 A1 * 12/2013 Wakahara ..... F21V 19/003 362/396

FOREIGN PATENT DOCUMENTS

EP 1014329 A2 6/2000
JP H11162431 A 6/1999
JP 2001250420 A 9/2001
JP 2006331856 A 12/2006
JP 2007335146 A 12/2007
JP 2011048975 A 3/2011
WO 2009037630 A1 3/2009

OTHER PUBLICATIONS

Korean Office Action based on application No. 10-2015-7011001(6 Pages) dated Jul. 14, 2016 (Reference Purpose Only).
Notice of Allowance issued in the corresponding Korean application No. 10-2015-7011001(3 Pages) dated Dec. 21, 2016 (Reference Purpose Only).

* cited by examiner

ORGANIC LIGHT-EMITTING ELEMENT HAVING QUICK DISCONNECT MEANS

RELATED APPLICATIONS

The present application is a national stage entry according to 35 U.S.C. § 371 of PCT application No.: PCT/EP2013/069867 filed on Sep. 24, 2013, which claims priority from German application No.: 10 2012 109 158.7 filed on Sep. 27, 2012, and is incorporated herein by reference in its entirety.

TECHNICAL FIELD

Various embodiments relate to a light-emitting element including a flat light-emitting means and a housing.

BACKGROUND

A flat light-emitting means can be circular, triangular, rectangular or else in the form of a polygon, for example. Furthermore, a freeform which can protrude out of the plane, for example, by virtue of it being possible for said freeform to be formed in 3D, in particular to be corrugated, for example, is also possible. The flat light-emitting means has a small thickness, for example a thickness of 2 cm, with the result that the flat light-emitting means has as low a height as possible. A flat light-emitting means is therefore substantially plate-shaped, and is formed from various elements or layers which are arranged stacked one on top of the other. The emission of the light output by the light-emitting means takes place over at least one subregion of an upper and/or lower side of the flat light-emitting means. An emission of the light output by the flat light-emitting means can also take place over one or more side surfaces of the flat light-emitting means, which side surfaces are arranged perpendicular to the upper and lower sides of the flat light-emitting means. If the flat light-emitting means is circular, the light-emitting means has a side surface which extends around the circumferential surface of the light-emitting means. If the flat light-emitting means is triangular, rectangular or in the form of a polygon, the light-emitting means has more than one side surface.

In order to form a light-emitting element which can be arranged in a lamp, for example, the flat light-emitting means is arranged in a housing, which can also be referred to as a fitting. The light-emitting means is fixed in the housing, which is generally performed using the upper and/or lower side of the light-emitting means, as a result of which that region of the upper and/or lower side of the light-emitting means over which light output by the light-emitting means can be emitted is limited since part of the upper and/or lower side is covered by the fixing of the light-emitting means in the housing.

In order to form an electrical contact, it is further known that in each case one contact element, for example in the form of a printed circuit board or an electrically conductive metal strip, is arranged on at least two subregions of the lower side and/or upper side of the light-emitting means. In the region of the lower and/or upper side, for example, in each case one cable is soldered to the contact elements or the contact elements are inserted into female connectors arranged independently of the housing or contact is made with said contact elements via pins, for example.

The cables, pins and female connectors require additional installation space within the light-emitting element, as a result of which the dimensions of the light-emitting element are increased in size.

Owing to the fixing of the light-emitting means in the housing by the upper and/or lower side of said light-emitting means and owing to the electrical contact with the light-emitting means to be formed independently of the housing, likewise over the upper and/or lower side of said light-emitting means, a conventional light-emitting element has a complicated back end process in its manufacture.

SUMMARY

Various embodiments provide a light-emitting element which can be made more compact and in which the production process, in particular the back end process, can be simplified.

In various embodiments, a light-emitting element may have: at least one flat light-emitting means, and a housing, in which the flat light-emitting means is arranged, wherein the flat light-emitting means is arranged in the housing in such a way that the housing surrounds a side surface of the flat light-emitting means at least partially, wherein the flat light-emitting means is held in the housing by virtue of the side face of said light-emitting means, and electrical contact is formed between the housing and the side surface of the flat light-emitting means.

Such a light-emitting element is substantially characterized by the fact that, in order to form an electrical contact, a mating contact element provided with respect to the contact element of the flat light-emitting means is arranged or integrated in or on the housing in which the flat light-emitting means is held. Additional cables or female connectors for connecting the contact elements arranged on the flat light-emitting means are in this case no longer necessary, as a result of which the number of components in the light-emitting element may be reduced. The contact elements of the flat light-emitting means make direct contact with the housing, wherein this electrical contact is made via the side surface, and in the case of a plurality of side surfaces via at least two side surfaces, of the flat light-emitting means. The side surfaces of the flat light-emitting means represent, for example, the end side surfaces of the flat light-emitting means. For this purpose, the housing bears against one or more side surfaces of the flat light-emitting means by virtue of the housing surrounding the side surface, and in the case of a plurality of side surfaces at least two side surfaces, of the flat light-emitting means. The flat light-emitting means is additionally held in the housing over the side surface or, in the case of a plurality of side surfaces, the at least two side surfaces by virtue of the flat light-emitting means being pressed or clamped in the housing over one or more side surfaces. The housing therefore forms, in addition to the electrical contact, a clamping fitting for the flat light-emitting means. The holding forces formed by the clamping-in or pressing-in for fixing the light-emitting means in the housing act exclusively in the plane of the light-emitting means owing to the fixing of the light-emitting means over the side faces of the light-emitting means, wherein, owing to the holding forces, the side surface provided with a contact element is pressed onto an inner surface of the housing, which inner surface has a mating contact element and is directed towards the side surface of the light-emitting means, and therefore safe contact is formed between the contact element and the mating contact element without further fastening means or holding means being required. In order to keep the dimensions of the entire light-emitting element as small as possible, the housing may have, in addition to a greater thickness, also the same thickness or a smaller thickness than the light-emitting means, with the result that the housing does not protrude beyond the surface of the light-emitting means. The total thickness of the light-emitting element may thus be reduced in comparison with conventional light-emitting elements.

Therefore, in the case of this light-emitting element, neither the electrical contact nor the fixing of the flat light-emitting means is performed in the housing over the upper and/or lower side of the light-emitting means, with the result that the emission surface on the upper and/or lower side of the light-emitting means for the light output by the light-emitting means may be increased in size since regions on the upper and/or lower side of the light-emitting means are no longer required for fixing the light-emitting means in the housing and for the formation of an electrical contact. Owing to the fact that both the fixing of the light-emitting means in the housing and the electrical contact with the light-emitting means are now performed over one or more side surfaces directly with the housing, the manufacturing process for the light-emitting element can be simplified, wherein in particular the back end process can be substantially simplified.

In order to form the electrical contact, a conductive surface element may be provided on the side surface of the light-emitting means, and a conductive mating surface element can be arranged on an inner surface of the housing which is directed toward the side surface, wherein the conductive surface element can be guided over an edge region of the flat light-emitting means from the upper and/or lower side of an element of the flat light-emitting means to a side surface of the flat light-emitting means. The conductive surface element and the conductive mating surface element have a particularly small thickness of, for example, 1 mm, in particular in the region of 200 μm, with the result that said surface elements require as small an installation space as possible and also the holding forces between the housing and the light-emitting means are not negatively influenced by the surface element or the mating surface element. The conductive surface element forms the contact element for the light-emitting means, wherein, for example, that part of the conductive surface element which is arranged on the side surface of the light-emitting means has the same size and therefore the same dimensions as the conductive mating surface element, with the result that electrical contact is possible over the entire surface of the surface element or the mating surface element. For example, the conductive surface element and/or the conductive mating surface element can be in the form of a conductive strip, for example a metal strip or a flexible printed circuit board. The conductive surface element is in this case formed so as to be bent around an edge region of the light-emitting means from the upper and/or lower side of an element of the light-emitting means to a side surface of the light-emitting means so that the conductive surface element has a right angle and is therefore L-shaped in cross section. As a result, a contact surface formed on the upper and/or lower side of an element of the flat light-emitting element can be guided by the surface element towards the side surface of the flat light-emitting means in order to be able to make contact with a mating contact element, in this case the mating surface element of the housing, on the side surface. Contact between the contact surface or the contact element arranged on the contact surface and a mating contact element on an upper and/or lower side of an element of the flat light-emitting means is thus avoided, as a result of which the back end process during manufacture of the light-emitting element can be simplified. Independently of the number of side surfaces of the flat light-emitting means, two or more conductive surface elements are arranged, wherein the number of conductive mating surface elements corresponds to the number of conductive surface elements. If the flat light-emitting means has only one side surface, two or more conductive surface elements are arranged at a distance from one another on one side surface. If the flat light-emitting means has more than one side surface, the two or more conductive surface elements are distributed over the plurality of side surfaces so that, for example, each side surface has only one conductive surface element.

The element of the flat light-emitting means, from whose upper and/or lower side the conductive surface element is guided to a side surface of the light-emitting means, may be a glass element. The element can form an outer surface of the flat light-emitting means, wherein the element can then be a substrate glass or a covering glass, also referred to as cap glass.

The fixing of the conductive surface element and/or of the conductive mating surface element may be performed by virtue of the fact that the conductive surface element is fastened on the side surface of the flat light-emitting means and the conductive mating surface element is fastened on the inner surface of the housing by bonding, welding or soldering, for example. As a result, a secure, nondetachable fastening of the conductive surface element on the light-emitting means and/or the conductive mating surface element on the housing can be formed. Alternatively, fastening can also be formed by adhesive bonding, riveting or screwing.

As an alternative to the arrangement of a conductive mating surface element on the inner surface of the housing, it is also possible for an electrical contact surface in the form of the mating contact element to be formed in on an inner surface of the housing, said inner surface pointing in the direction of the side surface of the light-emitting means. This formed-in electrical contact surface or the formed-in mating contact element can then make contact with a conductive surface element on the side surface of the flat light-emitting means. In this case, formed in means that the mating contact element is integrated directly in the housing so as to form an electrical contact surface, wherein, for example, the electrical contact surface or the mating contact element can already be incorporated in the housing as well, for example during manufacture of the housing. For example, the electrical contact surface or the mating contact element can be in the form of an injection-molded circuit carrier (molded interconnect device), which is incorporated in the housing formed from a plastics material.

As a further alternative, provision can be made for the electrical contact to be formed between the housing and the side surface of the flat light-emitting means by spring-mounted contact elements, such as contact springs or spring-mounted pins.

The housing may be in the form of a frame, with the result that the flat light-emitting means is surrounded by the housing on the side surface or side surfaces of said light-emitting means. The housing then has a similar design to a picture frame. The housing can have a base element, which covers a lower side of the flat light-emitting means. However, it is also possible for the housing not to have a base element and therefore for the upper and lower sides of the flat light-emitting means to be exposed and not to be covered by the housing, or only to be covered by the housing to a small extent. The housing then substantially exclusively surrounds the side surface/side surfaces of the flat light-emitting means, with the result that the flat light-emitting means can emit light over the upper and lower sides.

However, as an alternative, the housing can also cover the side surfaces of the flat light-emitting means sectionally, with the result that the housing is arranged so as not to be enclosed around the side surfaces of the light-emitting means.

In order to form the holder for the flat light-emitting means in the housing, the housing and/or the flat light-emitting means may have a latching mechanism. The latching mechanism may be in the form of grooves, channels, tongues, pins, webs, clamps and/or latching tabs, for example, which are arranged on the inner surface of the housing which points in the direction of the flat light-emitting means and/or the side surface/side surfaces of the flat light-emitting means.

Alternatively, in order to form the holder for the flat light-emitting means in the housing, it is possible for the housing to have an inner surface which is conical and/or for the side surface of the flat light-emitting means to be conical. As a result, secure clamping between the housing and the flat light-emitting means may be formed. This is particularly suitable when the flat light-emitting means is inserted into the housing from above and the light is emitted downwards by the light-emitting means in the fitted state. As an alternative to the conical formation, the inner surface of the housing can also have a different shape, for example a bulbous shape, by which a latching mechanism can be formed, for example.

The flat light-emitting means can have an organic light-emitting means (OLED) or be in the form of such an organic light-emitting means. An organic light-emitting means is characterized by a small thickness and a flat design. In addition, an organic light-emitting means has a high luminous efficacy and efficiency and is furthermore characterized by a long life. If OLEDs are used as light-emitting means, the light-emitting element can also have more than one light-emitting means, wherein the light-emitting means can then be arranged stacked one on top of the other, for example.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

In the detailed description below, reference is made to the attached drawings, which form part of this description and which show, for illustrative purposes, specific embodiments in which the invention can be implemented. In this regard, directional terminology such as, for example, "at the top", "at the bottom", "at the front", "at the rear", "front", "rear", etc. are used with reference to the orientation of the figure(s) described. Since components of embodiments can be positioned in a number of different orientations, the directional terminology serves for illustrative purposes and is in no way restrictive. It goes without saying that other embodiments can be used and structural or logical amendments can be made without departing from the scope of protection of the present invention. It goes without saying that the features of the various embodiments described herein can be combined with one another if not specifically specified otherwise. The following detailed description should therefore not be interpreted in a restrictive sense, and the scope of protection of the present invention is defined by the attached claims.

Within the scope of this description, the terms "connected" and "coupled" are used to describe both a direct connection and an indirect connection and direct coupling or indirect coupling. Identical or similar elements are provided with identical reference symbols in the figures, insofar as this is expedient.

Figure 1:
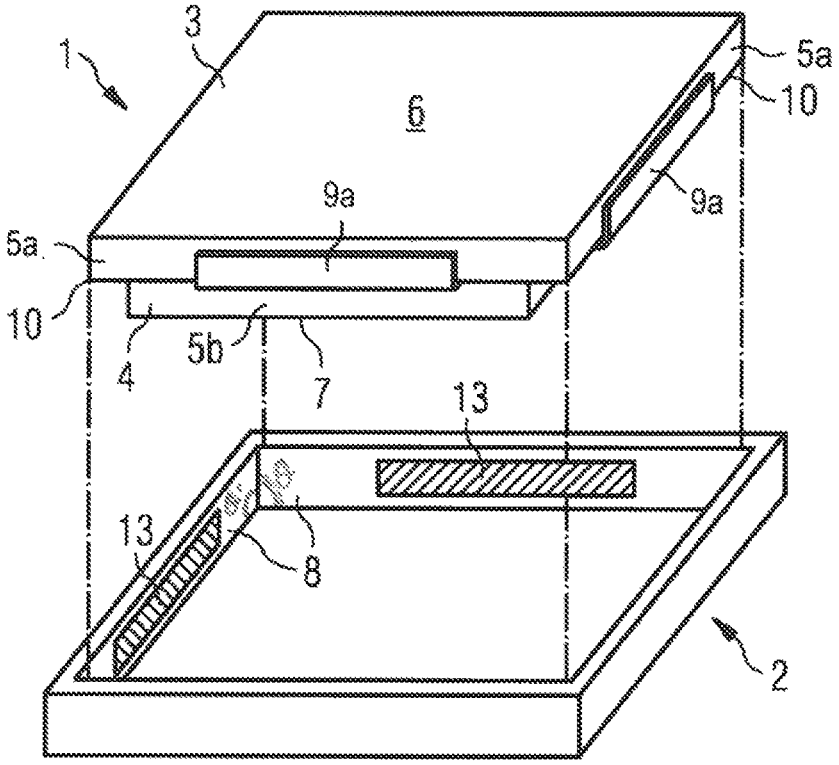
FIG. 1 shows a schematic illustration of a housing and a flat light-emitting a light-emitting element in a non-fitted state.

FIG. 1 shows a light-emitting element including a flat light-emitting means 1 and a housing 2, wherein the flat light-emitting means 1 can be inserted into the housing 2 from above, as is indicated by the dashed lines. As an alternative, however, it is also possible for the flat light-emitting means 1 to be inserted into the housing 2 from below.

The flat light-emitting means 1 is an organic light-emitting diode (OLED), which is formed from a plurality of layers or a plurality of elements stacked one on top of the other, wherein the OLED has two electrode layers, an organic layer structure which is arranged between the two electrode layers, and a substrate, in particular a substrate glass, on which the electrode layer in the form of an anode is arranged. A covering element, in particular covering glass, also referred to as cap glass, can be arranged on the electrode layer in the form of a cathode, wherein the two electrode layers and the organic layer structure are arranged between the substrate and the covering element.

The flat light-emitting means 1 in the form of an OLED shown in FIG. 1 has such a substrate glass 3 and covering glass 4, wherein the layers or elements arranged therebetween are not shown here. The flat light-emitting means 1 and therefore also the substrate glass 3 and the covering glass 4 are rectangular, for example square, in the embodiment shown here, wherein the dimensions of the covering glass 4 are smaller than the dimensions of the substrate glass 3, with the result that the covering glass 4 and the substrate glass 3 do not terminate flush with one another at their edges, but rather a step is formed between the two. However, it is also possible for the dimensions of the covering glass 4 to be identical to the dimensions of the substrate glass 3, with the result that the covering glass 4 and the substrate glass 3 terminate flush with one another at their edges (not shown here).

The flat light-emitting means 1 is inserted into the housing 2 in such a way that the light-emitting means 1 is held in the housing 2 over its side surfaces 5. The light-emitting means 1 shown here has four side surfaces 5*a*, 5*b* owing to its rectangular configuration, wherein the side surfaces 5*a*, 5*b* extend over the substrate glass 3 and the covering glass 4. The fastening of the light-emitting means 1 in the housing 2 can extend over the entire surface of a side surface 5*a*, 5*b* or only over a first subregion 5*a* of a side surface 5*a*, 5*b* in the region of the substrate glass 3 or over a second subregion 5*b* of a side surface 5*a*, 5*b* in the region of the covering glass 4. In the embodiment shown in FIG. 1 and on the left-hand side in FIG. 2, the fastening of the light-emitting means 1 in the housing 2 is performed over the side surfaces 5*a* of the substrate glass 3 of the light-emitting means 1. In the embodiment shown on the right-hand side in FIG. 2, the fastening of the light-emitting means 1 in the housing 2 is performed over the side surfaces 5*b* of the covering glass 4 of the light-emitting means 1, wherein the housing 2 in this case terminates laterally with the outer edges of the substrate glass 3.

The housing 2 is in the form of a frame, in the form of a picture frame, with the result that, in a fitted state, the housing 2 surrounds the light-emitting means 1 on its side surfaces 5*a*, 5*b*. The housing 2 shown here is open both at the bottom and at the top, with the result that the light-emitting means 1 in the fitted state now only bears against the housing 2, or is covered by said housing 2, with/on its side surfaces 5*a*, 5*b* and not with/on its upper side 6 and its lower side 7.

Fixing of the light-emitting means 1 in the housing 2 is performed via clamping on the side surfaces 5*a*, 5*b* of the light-emitting means 1 by virtue of the light-emitting means 1 being pressed into the housing 2 from above.

In addition to the formation of a holder for the light-emitting means 1, the housing 2 has the task of forming an electrical contact with the light-emitting means 1. For this purpose, contact elements are arranged on the light-emitting means 1, and mating contact elements are arranged on the housing 2. An electrical contact between the contact elements and the mating contact elements is made over the side surfaces 5*a*, 5*b* of the light-emitting means 1 and the inner surfaces 8 of the housing 2 which point towards the light-emitting means 1 in the fitted state.

In the embodiment shown here, the contact elements are in the form of first conductive surface elements 9*a*, 9*b* in the form of metal strips, which are each arranged on a region of a side surface 5*a*, 5*b*, in this case a side surface 5*a* of the substrate glass 3. The first conductive surface element 9*a*, as is shown on the left-hand side in FIG. 2 as well, is guided over an edge region 10 of the substrate glass 3 from a lower side 11 of the substrate glass 3 which points towards the covering glass 4 towards the side surface 5*a* of the substrate glass 3. An electrical contact surface 12 in the form of a substrate metallization is arranged on the lower side 11 of the substrate glass 3, wherein the contact of the contact surface 12 is guided toward the side surface 5*a* by the first surface element 9*a*, with contact being formed with the housing 2 at said side surface 5*a*. The back end process required in the manufacture of such a light-emitting element can thus be reduced to the attachment of the contact element, for example the first conductive surface element 9*a*, 9*b*, to the contact surface 12 by welding, in particular ultrasound welding, for example, wherein the first conductive surface element 9*a*, 9*b* is dimensioned such that it can be bent around an edge region 10, 14 of the light-emitting means 1, with the result that the first conductive surface element 9*a*, 9*b* forms an L shape in the attached state, as is shown in FIG. 2, for example.

Mating contact elements are arranged, corresponding to the number of contact elements of the light-emitting means 1, on the inner surface 8 of the housing 2, which mating contact elements are in the form of a second conductive surface element 13 in the form of a metal strip, in each case, in the embodiment shown here. By virtue of the light-emitting means 1 being pressed into the housing 2, in each case a first conductive surface element 9*a*, 9*b* is caused to bear against a mating second conductive surface element 13 in order to form an electrical contact between the light-emitting means 1 and the housing 2 by virtue of in each case one first conductive surface element 9*a*, 9*b* being pressed against a mating second conductive surface element 13.

Figure 2:
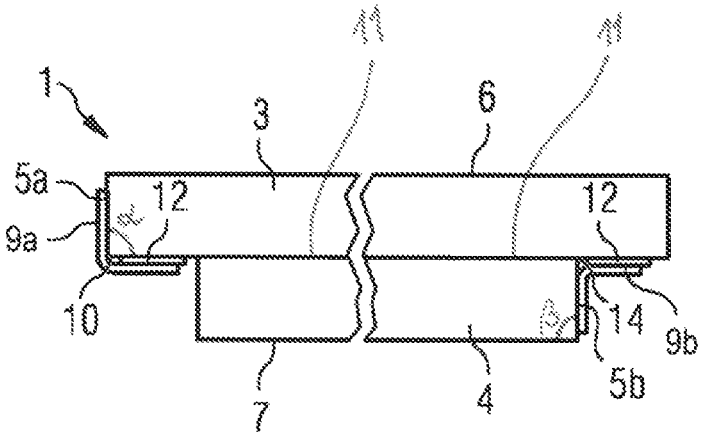
FIG. 2 shows a schematic illustration of a flat light-emitting means having two embodiments of the arrangement of a first conductive surface element.

An embodiment in which the first conductive surface element 9*b* is guided over an edge region 14, which is formed between the substrate glass 3 and the covering glass 4 and which forms a step so that the first conductive surface element 9*b* is guided from the lower side 11 of the substrate glass 3 to the side surface 5*b* of the covering glass 4 and therefore, in contrast to the embodiment shown in FIG. 1 and on the left-hand side in FIG. 2, electrical contact is formed between the side surface 5*b* of the covering glass 3 and the housing 2, is shown on the right-hand side in FIG. 2.

Various embodiments are therefore substantially characterized by the fact that contact elements are arranged on one or more side surfaces 5*a*, 5*b* of a light-emitting means 1 and mating contact elements are arranged on a housing 2 surrounding the light-emitting means 1, wherein an electrical contact is formed between in each case one contact element and one mating contact element. The contact element can in this case be in the form of a first conductive surface element 9*a*, 9*b* or else in the form of a spring-mounted contact element (not shown here). The mating contact element can be in the form of a mating second conductive surface element 13, in the form of an electrical contact surface formed into the inner surface 8 of the housing 2 (which contact surface is not illustrated here) or in the form of a spring element (not shown here).

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A light-emitting element, comprising:

at least one flat light emitter having a side surface, an edge region, a first conductive surface element arranged on the side surface, and an element with an upper side and a lower side; and a housing having a second conductive surface element arranged on an inner surface of the housing, the flat light emitter is received in the housing such that it surrounds the side surface of the flat light emitter at least partially, the inner surface of the housing facing the side surface of the light emitter with the first and second conductive surface elements forming an electrical contact there between, and the flat light emitter is held in the housing by cooperation between the side surface of the light emitter and the inner surface of the housing, wherein the first conductive surface element extends over the edge region of the flat light emitter from the upper side of the element of the flat light emitter to the side surface of the flat light emitter so that a contact surface formed on the upper or lower side of the element is extended to the side surface of the flat light emitter via the first conductive surface element to make contact with the second conductive surface element, and wherein an entire surface of the lower side and an entire surface of the upper side of the flat light emitter are not covered by the housing.

2. The light-emitting element as claimed in claim 1, wherein the element of the flat light emitter is a glass element.

3. The light-emitting element as claimed in claim 1, wherein the first conductive surface element is fastened on the side surface of the flat light emitter and the second conductive surface element is fastened on the inner surface of the housing by bonding, welding or soldering.

4. The light-emitting element as claimed in claim 1, wherein, in order to form the electrical contact, a second electrical contact surface is formed on the inner surface of the housing, said inner surface facing the side surface of the flat light emitter.

5. The light-emitting element as claimed in claim 1, wherein the electrical contact is formed by spring-mounted contact elements.

6. The light-emitting element as claimed in claim 1, wherein the housing is in the form of a frame.

7. The light-emitting element as claimed in claim 1, wherein, in order to form a holder for the flat light emitter in the housing, the housing and/or the flat light emitter has/have a latching mechanism.

8. The light-emitting element as claimed in claim 1, wherein, in order to form a holder for the flat light emitter in the housing, the housing has an inner surface, which is conical and/or the side surface of the flat light emitter is conical.

9. The light-emitting element as claimed in claim 1, wherein the flat light emitter has an organic light emitter or is in the form of such an organic light emitter.

10. The light-emitting element as claimed in claim 1, wherein the element of the flat light emitter is a substrate glass or a covering glass.

11. A light-emitting element, comprising:

at least one flat light emitter having a side surface, an edge region, a first conductive surface element arranged on the side surface, and an element with an upper side and a lower side; and a housing having a second conductive surface element arranged on an inner surface of the housing, the flat light emitter is received in the housing such that it surrounds the side surface of the flat light emitter at least partially, the inner surface of the housing facing the side surface of the light emitter with the first and second conductive surface elements forming an electrical contact there between, and the flat light emitter is held in the housing by cooperation between the side surface of the light emitter and the inner surface of the housing, wherein the first conductive surface element extends over the edge region of the flat light emitter from the upper side of the element of the flat light emitter to the side surface of the flat light emitter so that a contact surface formed on the upper or lower side of the element is extended to the side surface of the flat light emitter via the first conductive surface element to make contact with the second conductive surface element, and wherein an entire surface of the lower side of the flat light emitter is exposed, and wherein the element of the flat light emitter comprises a substrate glass and a covering glass and wherein lateral dimensions of the covering glass are smaller than lateral dimensions of the substrate glass so that the covering glass and the substrate glass do not terminate flush with one another at their edges.

* * * * *